US006694786B2

(12) United States Patent
Gotou et al.

(10) Patent No.: US 6,694,786 B2
(45) Date of Patent: Feb. 24, 2004

(54) DOOR LOCKING HANDLE ASSEMBLY WITH BUILT-IN COMBINATION LOCK

(75) Inventors: Kazuyuki Gotou, Tokyo (JP); Shirou Segawa, Tokyo (JP)

(73) Assignee: Takigen Manufacturing Co. Ltd., Tokyo (JP)

( * ) Notice: Subject to any disclaimer, the term of this patent is extended or adjusted under 35 U.S.C. 154(b) by 0 days.

(21) Appl. No.: 10/282,146

(22) Filed: Oct. 28, 2002

(65) Prior Publication Data

US 2004/0011095 A1 Jan. 22, 2004

(30) Foreign Application Priority Data

Jul. 18, 2002 (JP) ..... 2002-209149

(51) Int. Cl.[7] ..... E05B 13/00; E05B 37/00

(52) U.S. Cl. ..... 70/213; 70/215; 70/219; 70/221; 70/224; 70/284

(58) Field of Search ..... 70/208, 210, 213, 70/215, 219, 221, 224, 284, 285; 292/DIG. 31

(56) References Cited

U.S. PATENT DOCUMENTS 4,356,712 A * 11/1982 Bako ..... 70/69
4,557,122 A * 12/1985 Hwang ..... 70/312
4,770,013 A * 9/1988 Nakai ..... 70/285
4,852,371 A * 8/1989 Pfeiffer ..... 70/70
4,972,691 A * 11/1990 Knight ..... 70/89
5,020,346 A * 6/1991 Eisermann ..... 70/278.5
5,063,764 A * 11/1991 Amis et al. ..... 70/100
5,345,798 A * 9/1994 Nakai ..... 70/284
5,467,623 A * 11/1995 Yamada et al. ..... 70/208
5,638,708 A * 6/1997 Hsu ..... 70/84

* cited by examiner

*Primary Examiner*—Anthony Knight
*Assistant Examiner*—Christopher Boswell
(74) *Attorney, Agent, or Firm*—Martin Smolowitz

(57) ABSTRACT

In the handle assembly, a combination lock (6) is opened by turning each dial discs (4) a given number of times to establish a combination of marks on the discs, and is incorporated in a handle (2) and disposed adjacent to a cylinder lock (13) in the handle. A receiver lever (16) pivoted on a base body (1), is controlled by a lock plate (5). A stopping plate (11), interlocked with a rotor (8) of the cylinder lock (13), engages receiver lever (16) pivoted to the base body (1), so that the handle (2) is held in its folded position. When the combination lock (6) is in its unlocked condition and the handle (2) is pulled, the receiver lever (16) is swung upward by the stopping plate (11) to release handle (2) from the base body (1). A plurality of slots (68) are formed on a bottom surface of a dent portion (100) of the handle (2). An outer peripheral portion of each of the dial discs (4) projects into the dent portion (100) through the slot (68) so that an outer peripheral surface of the dial disc (4) is set back from a virtual extension plate of the front surface (2*a*) of the handle (2). The handle assembly is attached to a door (30) front side having an opening (32) into which the base body (1) is fitted and retained by a pivoted fastening stopper (80) actuated by set screw (82) fixing arrangement.

7 Claims, 13 Drawing Sheets

DOOR LOCKING HANDLE ASSEMBLY WITH BUILT-IN COMBINATION LOCK

BACKGROUND OF THE INVENTION

1. Field of the Invention

The present invention relates to a door-locking handle assembly with a built-in combination lock of a pull-out and side-swinging lever-action type, in which a door handle is pivoted to a base body of the assembly so as to be pulled out forward and pushed back rearward relative to the base body and turned on its pivoted end.

2. Description of the Related Art

As is well known in the art, a door locking handle assembly of a conventional type has a construction in which: a base body of the, assembly is fixedly mounted on a door of a box or container, a door handle is pivoted to the base body so as to be pulled out forward and pushed back rearward relative to the base body and further turned sideward on its pivoted end after completion of its pulling-out operation; when the door handle is pulled out of the base body to assume its pulled-up or raised inclination position relative to the base body and turned sideward after completion of its pulling-out operation, a catch plate (i.e., locking member) which serves as a door bolt directly or indirectly connected with the door handle is released from a receiving portion of a stationary frame element (i.e., door frame) of the box or container. In this type of conventional door locking handle assembly, a cylinder lock is incorporated in either the door handle or the base body on the other hand, the door handle is pushed back rearward relative to the base body and held in its folded position or locked position in the base body.

In the conventional door locking handle assembly having the above construction, an available space for mounting the assembly is extremely limited in each of opposite sides of the door to which the assembly is fixedly mounted because the interior space of the box or container for housing various instruments therein is relatively limited due to the presence of the instruments housed in the box or container. Due to this, it is necessary to considerably limit in size the projections of the assembly in opposite directions perpendicular to the plane of the door's surface.

In order to fulfill the above need, it is necessary to reduce in thickness the assembly as a whole by reducing in thickness the door handle and in depth the base body. However, this forces the cylinder lock of the assembly to be considerably reduced in thickness.

On the other hand, in such a thin-type cylinder lock, since the number of sets of disc tumblers and/or pin tumblers incorporated in the cylinder lock as essential components of its internal lock mechanism is small, the number of available keys of such a thin-type cylinder lock is naturally limited. Due to this, in the case where there are a large number of eligible users or persons using the instruments contained in the box which is provided with the door locking handle assembly employing the cylinder lock in a condition in which these users or persons are controlled by a control operator through a computerized personal management system, it is difficult to use the conventional door locking handle assembly which employs the thin-type cylinder lock.

Also, in the conventional door locking handle assembly, the base body if fixed to the door by fitting screws into threaded holes formed on the door by way of through holes, which is formed on a front plate portion projection from the front end of the base body. Otherwise, the base body is fixed to the door by fitting screws into threaded holes of the base body from the rear side of the door by way of through holes of the door.

However, in such an attaching structure described above, it is necessary to form threaded holes and through holes on the door body adjacent to both longitudinal ends of the base body in addition to the attaching opening for receiving the base body. Therefore, it increases the processing of perforating such holes, and it makes the attaching operation troublesome or complicated because operators or workers have to hold the door handle assembly at a given attaching position form the front side of the door in conducting the screw fixing operation.

In a door handle assembly as shown in the Japanese utility model opening gazette No. Heisei 3-54274, a base body is provided with a cover plate on its front end portion, and a slant surface portion is formed on one of longitudinal ends of the base body, which slant surface portion is inclined relative to said cover plate. In attaching operation of the door handle assembly, a door is inserted between the cover plate and the slant surface portion, and then the door handle assembly is embedded into an attaching opening of the door so that the door is put between an engagement block and a slant surface portion, which is formed on the other of longitudinal ends of the base body. Also, in this attaching structure, the operation efficiency of attaching is not good because operators or workers have to hold the door handle assembly at a given attaching position from the front side of the door in conducting the screw fixing operation.

SUMMARY OF THE INVENTION

Under such circumstances, the present invention was made. Consequently, it is an object of the present invention to provide a door locking handle assembly with a built-in combination lock, which assembly is thin in thickness as a whole and capable of providing a very large number of available keys for the combination lock, wherein a large number of eligible persons or users of various instruments contained in a box or container provided with the door locking handle assembly are precisely controlled by a control operator through a computerized personal management system.

It is another object of the present invention to provide the door locking handle assembly, wherein it is not necessary to perforate threaded holes and through holes for attaching screws in the door, and the operation efficiency of attaching is more improved because operators or workers do not need to hold the door handle assembly at a given attaching position from the front side of the door in the screw fixing operation.

It is a further object of the present invention to provide the door locking handle assembly, which is adapted to various doors that are different from each other in thickness.

In accordance with a first aspect of the present invention, the above object of the present invention is accomplished by providing:

a base body fixedly mounted on a door 30 of a box, wherein a handle 2 is pivoted to the base body 1 so as to be capable of being pulled out forward and pushed back rearward relative to the base body 1, wherein a locking member 3 serving as a door bolt for locking the door 30 to a main body of the box is directly or indirectly connected with the handle 2 so as to be engaged with and disengaged from a receiving portion of a stationary frame element such as the main body of the box when the handle 2 is pulled out forward and then turned sideward on the locking shaft 29 after completion of the pulling-out operation of the door handle 2, the improvement wherein:

the combination lock 6, which is provided with a plurality of marked dial discs 4, is incorporated in the handle 2 and opened by turning each of the marked dial discs 4 a given number of times to establish a predetermined combination of marks for unlocking, which is provided in outer peripheral surfaces of the dial discs 4;

the combination lock 6 is held in its locked condition when the predetermined combination of marks for unlocking is not established;

a plurality of slots 68 are formed on a bottom surface of a dent portion 100, which is formed on a front surface of said handle 2;

an outer peripheral portion of each of said dial discs 4 projects into said dent portion 100 through said slot 68 in such a manner that an outer peripheral surface of said dial disc 4 is set back from a virtual extension plane of the front surface 2*a* of said handle 2;

a cylinder lock 13 is incorporated in the handle 2 and disposed adjacent to the combination lock 6 in a longitudinal direction of the handle 2, wherein the cylinder lock 13 is provided with a rotor 8;

when an eligible key 7 is inserted into a keyhole 9 of the rotor 8 of the cylinder lock 13, the cylinder lock 13 has its internal lock mechanism 10 unlocked to permit the rotor 8 to be turned by the key 7 thus inserted into the keyhole 9 of the rotor 8;

when the rotor 8 is turned, a stopper plate 11 which is slidably received in a side through-hole 12 of the handle 2 is driven in a manner such that the stopping plate 11 is projected outward from the side through-hole 12 and retracted from the outside of the handle 2.

And, the stopping plate 11 has its upper end portion 14 abut against a shoulder portion 15 of a lower surface of a proximal end portion of a receiver lever 16;

the receiver lever 16 has its proximal end portion pivoted to an inner wall portion of the base body 1 through a first pivot 17;

the shoulder portion 15 of the receiver lever 16 is provided with a cam slope 18 through which the receiver lever 16 is pushed upward by the upper end portion of the stopper plate 11;

the receiver lever 16 is rotatably urged toward the stopping plate 11 by means of a first spring member 19;

a slider 21 is disposed in parallel with a center pin 20 of the combination lock 6, and urged toward the cylinder lock 13 by means of a second spring member 22 in a manner such that a lower end portion 23 of the slider 21 abuts against an upper surface of the receiver lever 16, so that the slider 21 has its restriction portion 26 engaged with and disengaged from a locking end portion 25 of a lock plate 5 when the lock plate 5 is held in its locked position and its unlocked position, respectively.

And, when the lock plate 5 is held in its unlocked position, the handle 2 is capable of being pulled forward out of the base body 1;

when the handle 2 is thus pulled out forward, the stopping plate 11 pushes the cam slope 18 of the receiver lever 16 swingably upward so that the receiver lever 16 is moved to its unlocked positon; and when the lock plate 5 is held in its locked position, the lock plate 5 has its locking end portion 25 engaged with the restriction portion 26 of the slider 21 to prevent the receiver lever 16 from turning on the first pivot 17.

In accordance of the second aspect of the present invention, the above object of the present invention is accomplished by providing:

In the door locking handle assembly of the invention described above has further the following structure, wherein;

said base body 1 is fitted into an attaching opening 32 of a door 30 from the front side of the door 30, and a front flange 93 is formed on outer surface of the base body 1, which the front flange abuts on a front surface 30*a* of the door 30;

a rear projection 90, which is formed on one of longitudinal ends of the base body 1, passes through the attaching opening 32 to the rear side of the door 30;

a rear edge portion 32*a* of one of longitudinal ends of the attaching opening 32 engages with a locating groove 92, which is formed between said rear projection 90 and one of longitudinal ends 93*a* of said front flange 93;

a hollow portion 94, which is formed in the other of longitudinal ends of said base body 1 disposed on the rear side of the door 30, is opened toward the other end 93*b* of longitudinal ends of said front flange 93 a fastening stopper 80 is housed in said hollow portion 94, and pivoted to said base body 1 by a pivot 81 which is parallel to the font surface 30*a* of said door 30;

a set screw 82 is fitted through a threaded hole 89, which is formed in a rear wall portion the base body 1, and a leading end of the set screw 82 projects into the hollow portion 94; and a front side edge surface 80*a* of said fastening stopper 80 is brought info engagement with both a rear surface 93*c* of said end portion 93*b* of the front flange 93 and a rear side edge portion 32*b* of the other of longitudinal ends of said attaching opening 32 with pressing the fastening stopper 80 by said set screw 82.

In accordance of the third aspect of the present invention, the above object of the present invention is accomplished by providing:

In the door locking handle assembly of the invention described above has further the following structure, wherein;

when the base body 1 is inserted into the attaching opening 32 of the door 30, a first cam surface portion 83, which is formed on the outer edge of said fastening stopper 80, slidably contacts with the front side edge portion 32*c* of the other of longitudinal ends of the attaching opening 32 so that the fastening stopper 80 is retreated into said hollow portion 94;

when the set screw 82 is fitted through the threaded hole 89, a second cam surface portion 84, which is formed on the inner edge of the fastening stopper 80, slidably contacts with a leading end of said set screw 82 so that the fastening stopper 80 is pushed out ward from the hollow portion 94.

In accordance of the fourth aspect of the present invention, the above object of the present invention is accomplished by providing:

In the door locking handle assembly of the invention described above has further the following structure, wherein;

a spring member 85, which is disposed between the fastening stopper 80 and the base body 1, urges the fastening stopper 80 so as to project outside of the rear edge portion 32*b* of the attaching opening 32.

In accordance of the fifth aspect of the present invention, the above object of the present invention is accomplished by providing:

In the door locking handle assembly of the invention described above has further the following structure, wherein;

said front side edge surface 80*a* of said fastening stopper 80, which is formed as a curved shape, engages with both the rear surface 93*c* of said end portion 93*b* of the front flange 93 and the rear side edge portion 32*b* of the other of longitudinal ends of said attaching opening 32.

In accordance of the sixth aspect of the present invention, the above object of the present invention is accomplished by providing:

in the door locking handle assembly of the invention described above has further the following structure, wherein;

a threaded hole 98 is formed on said rear projection 90 of the base body 1 upright to the door 30, and a leading end of a pushing screw 97, which is fitted into said threaded hole 98, abuts onto a rear surface 30*b* of the door 30.

BRIEF DESCRIPTION OF THE DRAWINGS

The above and other objects, advantages and features of the present invention will be more apparent from the following description taken in conjunction with the accompanying drawings in which.

DETAILED DESCRIPTION OF THE PREFERRED EMBODIMENTS

Figure 1:
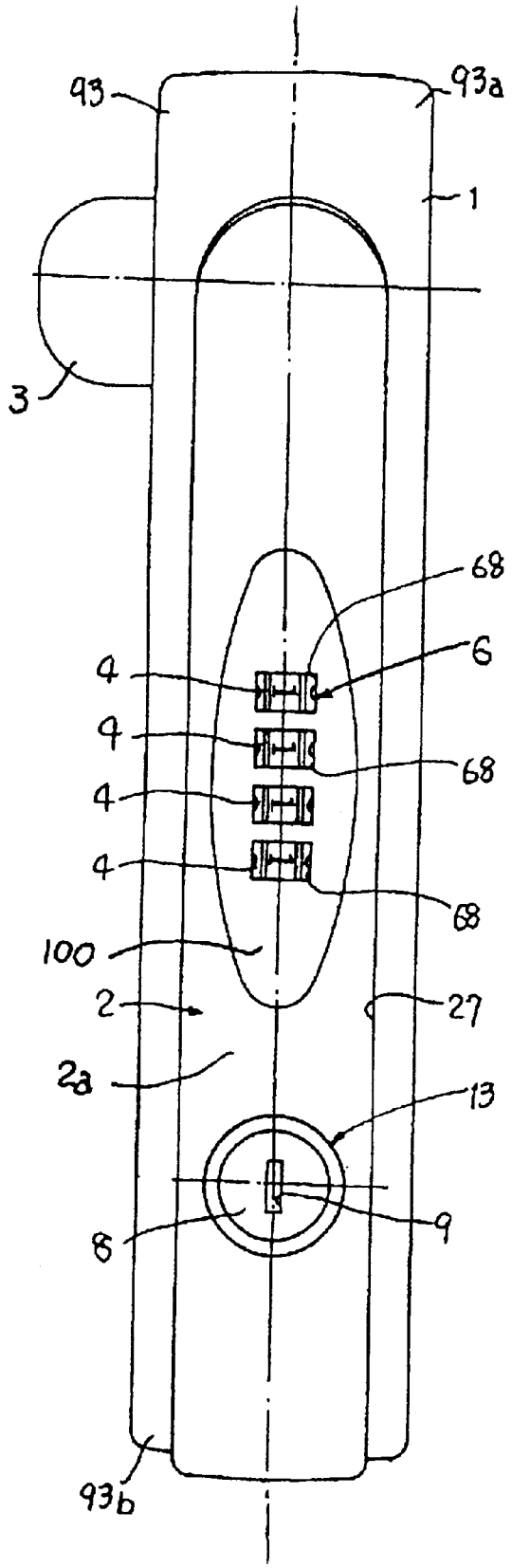
FIG. 1 is a front view of an embodiment of the door locking handle assembly of the present invention.
Figure 2:
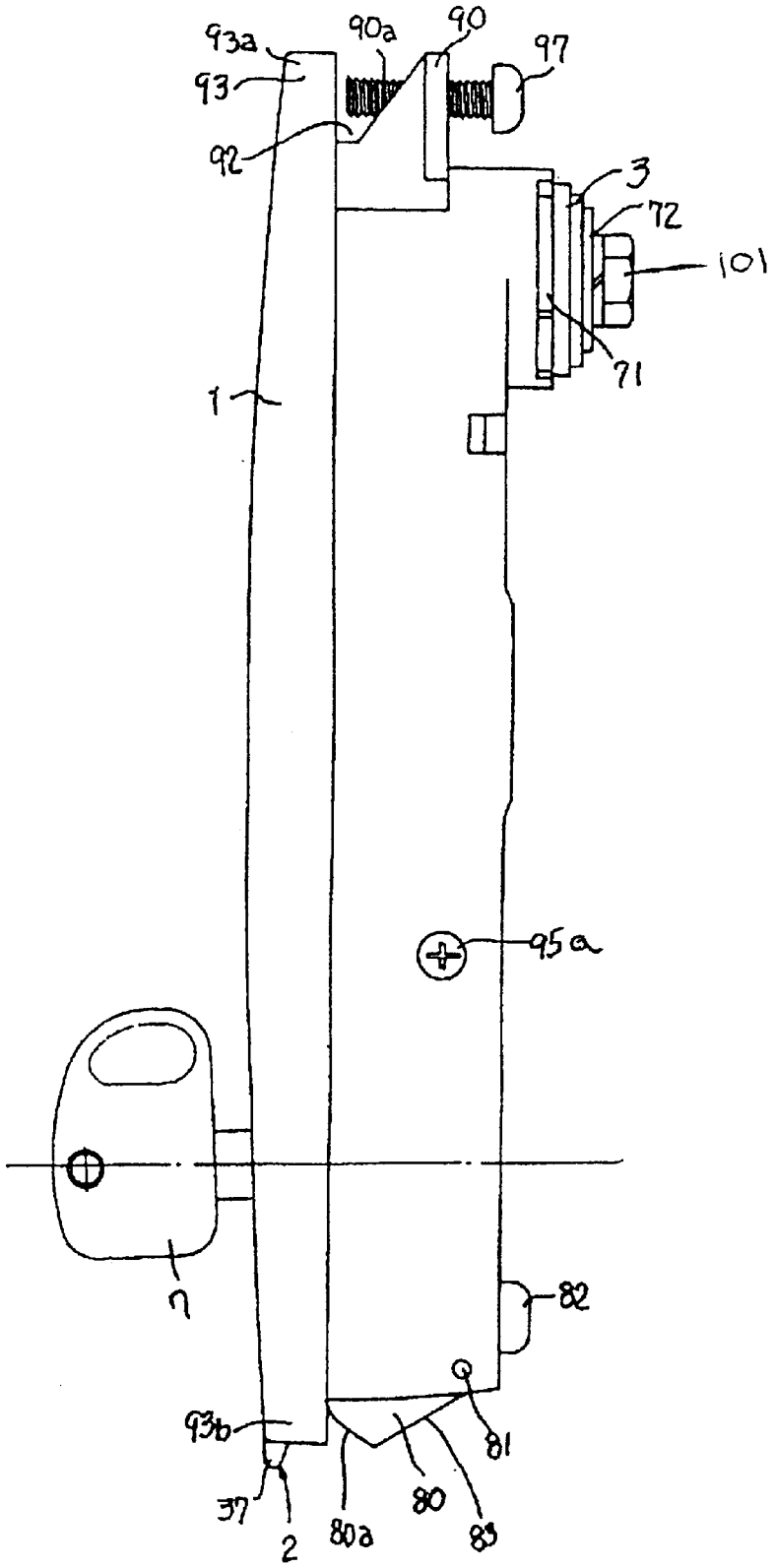
FIG. 2 is a right side view of the door locking handle assembly shown in FIG. 1.
Figure 3:
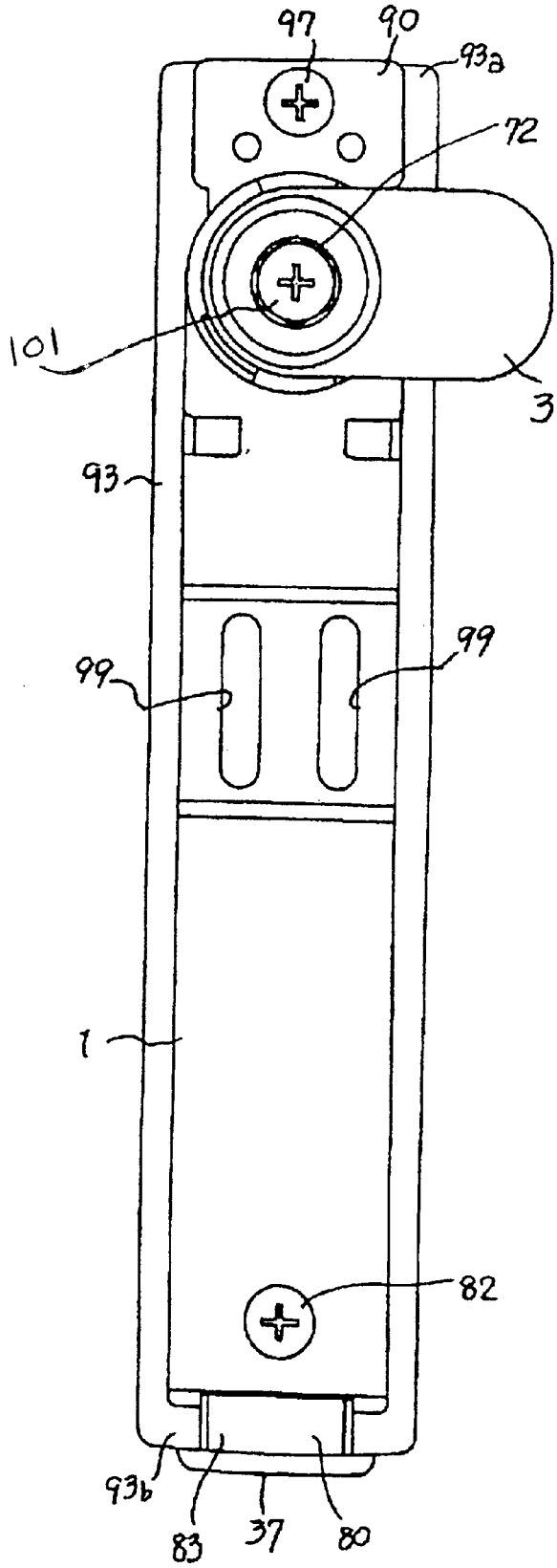
FIG. 3 is a rear view of the door locking handle assembly shown in FIG. 1.

The best modes for carrying out the present invention will be described in detail using embodiments of the present invention with reference to the accompanying drawings.

As shown in the drawings, a based body 1 fixedly mounted on a door 30 of a box, wherein a handle 2 is pivoted to the base body 1 so as to be capable of being pulled out forward and pushed back rearward relative to the base body 1.

A locking member 3 serving as a door bolt for locking the door 30 to a main body of the box is directly or indirectly connected with the handle 2 so as to be engaged with and disengaged from a receiving portion of a stationary frame element such as the main body of the box when the handle 2 is pulled out forward and then turned sideward on the locking shaft 29 after completion of the pulling-out operation of the door handle 2.

The combination lock 6, which is provided with a plurality of marked dial discs 4, is incorporated in the handle 2 and opened by turning each of the marked dial discs 4 a given number of times to establish a predetermined combination of marks for unlocking, which is provided in outer peripheral surfaces of the dial discs 4.

The combination lock 6 is held in its locked condition when the predetermined combination of marks for unlocking is not established. A plurality of slots 68 are formed on a bottom surface of a dent portion 100, which is formed on a front surface of said handle 2. An outer peripheral portion of each of said dial discs 4 projects into said dent portion 100 through said slot 68 in such a manner that an outer peripheral surface of said dial disc 4 is set back from a virtual extension plane of the front surface 2*a* of said handle 2.

A cylinder lock 13 is incorporated in the handle 2 and disposed adjacent to the combination lock 6 in a longitudinal direction of the handle 2, wherein the cylinder lock 13 is provided with a rotor 8. When an eligible key 7 is inserted into a keyhole 9 of the rotor 8 of the cylinder lock 13, the cylinder lock 13 has its internal lock mechanism 10 unlocked to permit the rotor 8 to be turned by the key 7 thus inserted into the keyhole 9 of the rotor 8. When the rotor 8 is turned, a stopper plate 11 which is slidably received in a side through-hole 12 of the handle 2 is driven in a manner such that the stopping plate 11 is projected outward from the side through-hole 12 and retracted from the outside of the handle 2.

And, the stopping plate 11 has its upper end portion 14 abut against a shoulder portion 15 of a lower surface of a proximal end portion of a receiver lever 16. The receiver lever 16 has its proximal end portion pivoted to an inner wall portion of the base body 1 through a first pivot 17 The shoulder portion 15 of the receiver lever 16 is provided with a cam slope 18 through which the receiver lever 16 is pushed upward by the upper end portion of the stopper plate 11. The receiver lever 16 is rotatably urged toward the stopping plate 11 by means of a first spring member 19.

A slider 21 is disposed in parallel with a center pin 20 of the combination lock 6, and urged toward the cylinder lock 13 by means of a second spring member 22 in a manner such that a lower end portion 23 of the slider 21 abuts against an upper surface of the receiver lever 16, so that the slider 21 has its restriction portion 26 engaged with and disengaged from a locking end portion 25 of the lock plate 5 when the lock plate 5 is held in its locked position and its unlocked position, respectively.

And, when the lock plate 5 is held in its unlocked position, the handle 2 is capable of being pulled forward out of the base body 1. When the handle 2 is thus pulled out forward, the stopping plate 11 pushes the cam slope 18 of the receiver lever 16 swingably upward so that the receiver lever 16 is moved to its unlocked position. When the lock plate 5 is held in its locked position, the lock plate 5 has its locking end portion 25 engaged with the restriction portion 26 of the slider 21 to prevent the receiver lever 16 from turning on the first pivot 17.

In the door locking handle assembly described above, in the attaching operation of the locking handle assembly to the door 30, the base body 1 is fitted into an attaching opening 32 of a door 30, at first from one of longitudinal ends, from the front side of the door 30 so that the rear edge portion 32*a* of one of longitudinal ends of the attaching opening 32 is engaged with a locating groove 92 between said rear projection 90 and one of longitudinal ends 93*a* of said front flange 93 .

By rotating the base body 1 about the engagement point above toward the door 30, the base body 1 is fitted into the attaching opening 32 up to the other of longitudinal ends. Thereby, the front flange 93 abuts on the front surface 30*a* of the door 30 at all of the length thereof.

Thereafter, the set screw 82 is driven by a driver from the rear side of the door 30 so that the leading end of the set screw 82, which projects in to the hollow portion 94 of the base body 1, pushes the fastening stopper 80. By such a pushing operation, the fastening stopper 80 is rotated outward on the center of the pivot 81, so that the front side edge surface 80*a* of the fastening stopper 80 is brought into engagement with both the rear surface 93*c* of said end portion 93*b* of the front flange 93 and the rear side edge portion 32*b* of the other of longitudinal ends of the attaching opening 32.

In such a way, the base body 1 is fixedly fastened to the door 30 with having the front flange 93 abutted on the front surface 30*a* thereof.

In the door locking handle assembly of the invention when the base body 1 is inserted into the attaching opening 32 of the door 30, the fastening stopper 80 is retreated into said hollow portion 94, because the first cam surface portion 83 of the fastening stopper 80 slides on the front side edge portion 32*c* of the attaching opening 32.

Also, when the set screw 82 is fitted into the threaded hole 89, the fastening stopper 80 is pushed out ward from the hollow portion 94, because the leading end of said set screw 82 slides on the second cam surface portion 84 of the fastening stopper 80. And thereby, the front side edge surface 80*a* of the fastening stopper 80 is engaged with both the rear surface 93*c* of the end portion 93*b* of the front flange 93 and the rear side edge portion 32*b* of the attaching opening 32.

In the door locking handle assembly of the invention when the base body 1 is inserted into the attaching opening 32, the first cam surface portion 83 slides on the front side edge portion 32*c* so that the fastening stopper 80 is retreated into said hollow portion 94. On the other hand, when the front flange 93 abuts on the front surface 30*a* of the door 30, the fastening stopper 80 is rotated outward by the spring 85 , and at a last stage of such rotation, the front side edge surface 80*a* of the fastening stopper 80 is engaged with both the rear surface 93*c* of the front flange 93 and the rear side edge portion 32*b* of the attaching opening 32.

In the door locking handle assembly of the invention the front side edge surface 80*a* of the fastening stopper 80 is engaged with both the rear surface 93*c* of the front flange 93 and the rear side edge portion (32*b*) of the attaching opening (32) at a certain point on the curved profile thereof, which is determined in accordance with thickness of the door 30.

In the door locking handle assembly of the invention base body 1 is fixed on the door 30 with cooperation of the locating groove 92 and the fastening stopper 80, and thereafter, the leading end of a pushing screw 97, which is fitted into said threaded hole 98, abuts or pushes to the rear surface 30*b* of the door 30.

In the door locking handle assembly of the present invention, a control operator of the instruments housed in the box is capable of allocating to each of a large number of eligible users or persons such a predetermined unique combination of marks of the marked dial discs 4 of the combination lock 6 for unlocking and locking the combination lock 6.

Each of the eligible users or persons is capable of unlocking the combination lock 6 of the door locking handle assembly by inserting a finger up into the front dent portion 100 of the handle so as to touch to the outer peripheral surfaces 4*a* of the marked dial discs 4, and by turning in a normal or a reverse direction each of the marked dial discs 4 a given number of times to establish the unique combination of the marks, which combination has been allocated to each of the eligible users or persons, wherein the marks are provided in an outer peripheral surface of each of the dial discs 4.

Figure 4:
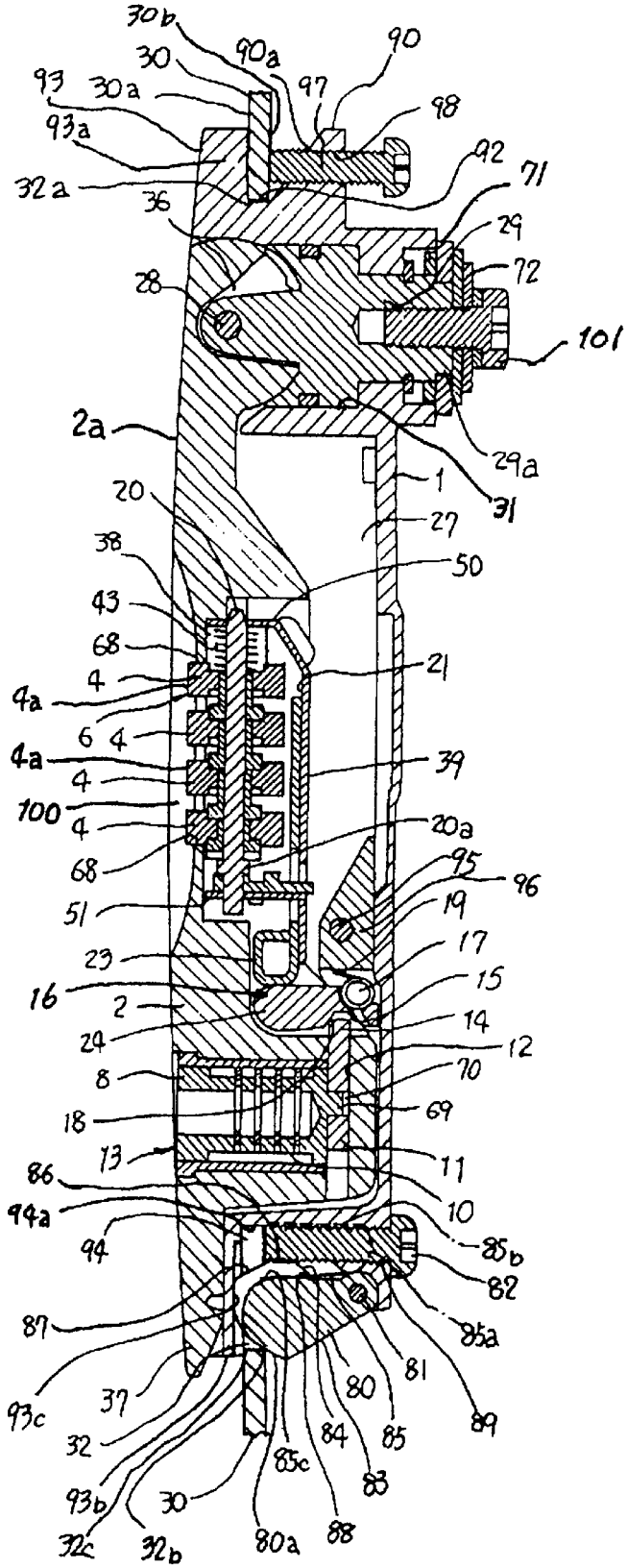
FIG. 4 is a schematic longitudinal sectional view of the door locking handle assembly shown in FIG. 1, illustrating a predetermined unique combination of the marks of the dial discs of the combination lock.
Figure 5:
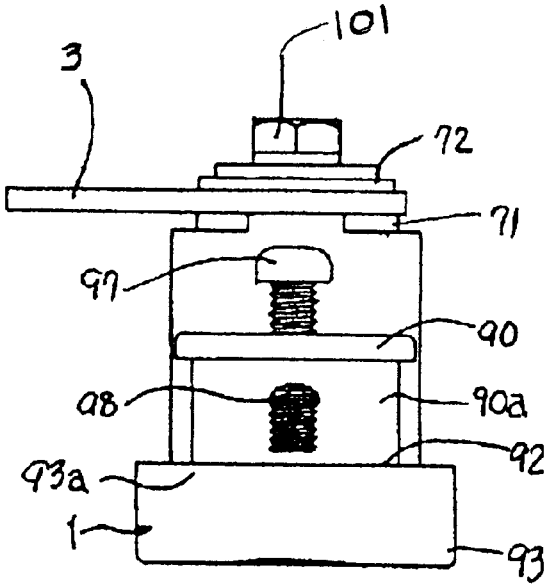
FIG. 5 is a plan view of the door locking handle assembly shown in FIG. 1.
Figure 6:
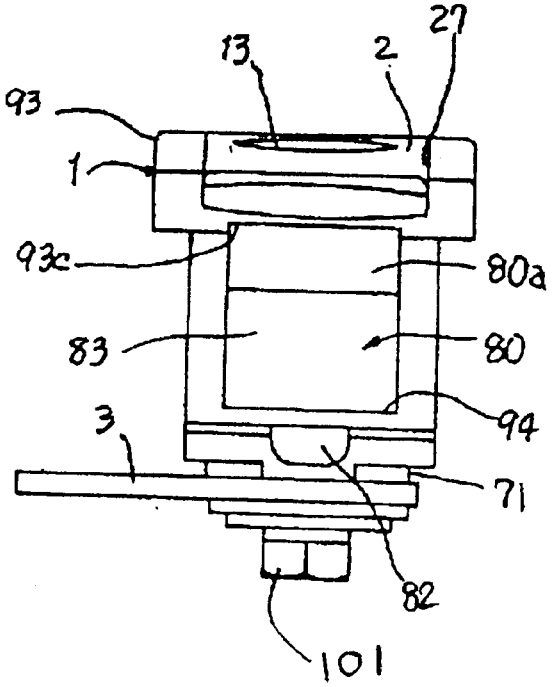
FIG. 6 is a bottom view of the door locking handle assembly shown in FIG. 1.
Figure 7:
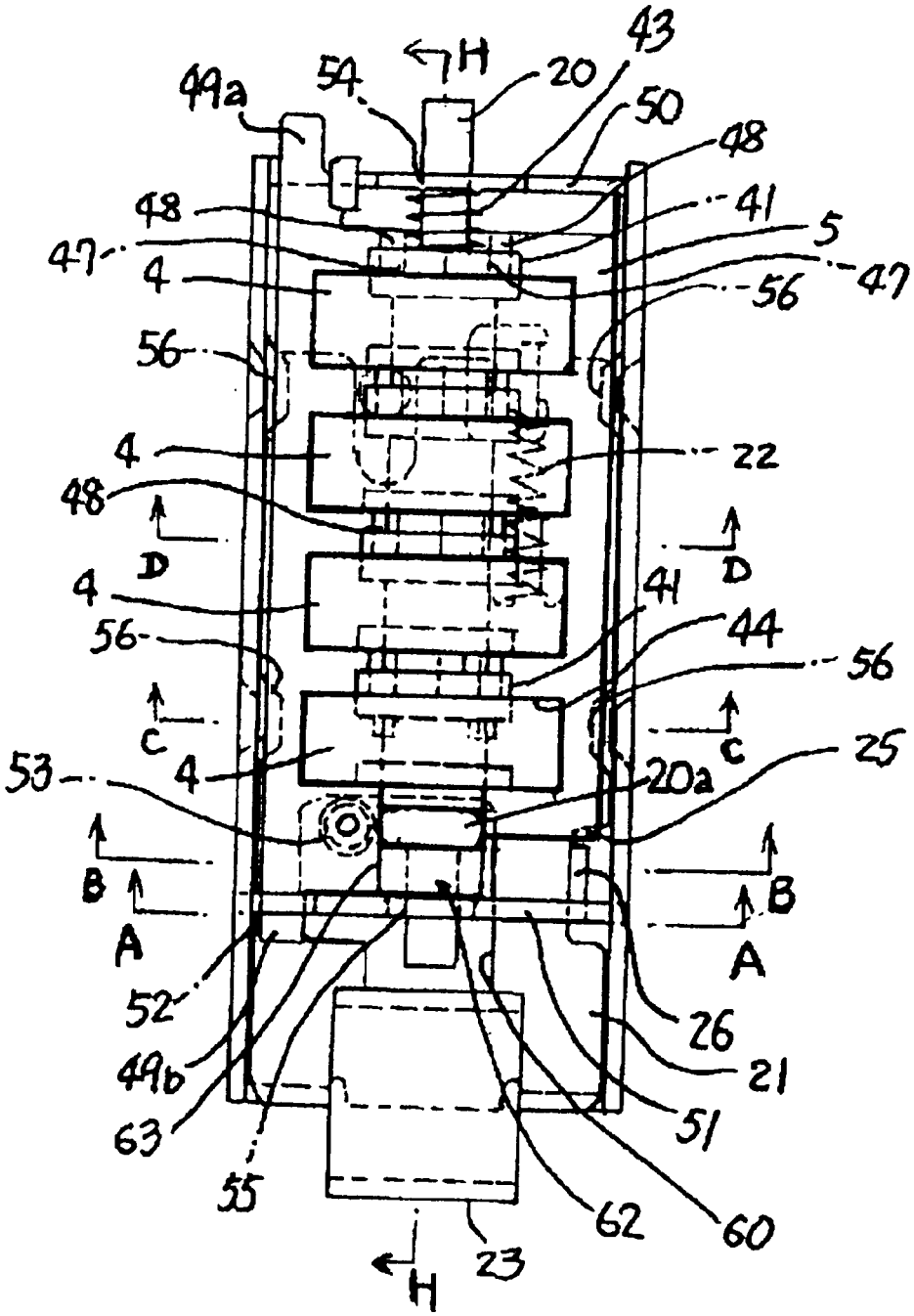
FIG. 7 is a front view of the built-in combination lock of the door locking handle assembly shown in FIG. 1, illustrating the dial discs the marks of which are not shown together with the positioning grooves of these marks.
Figure 8:
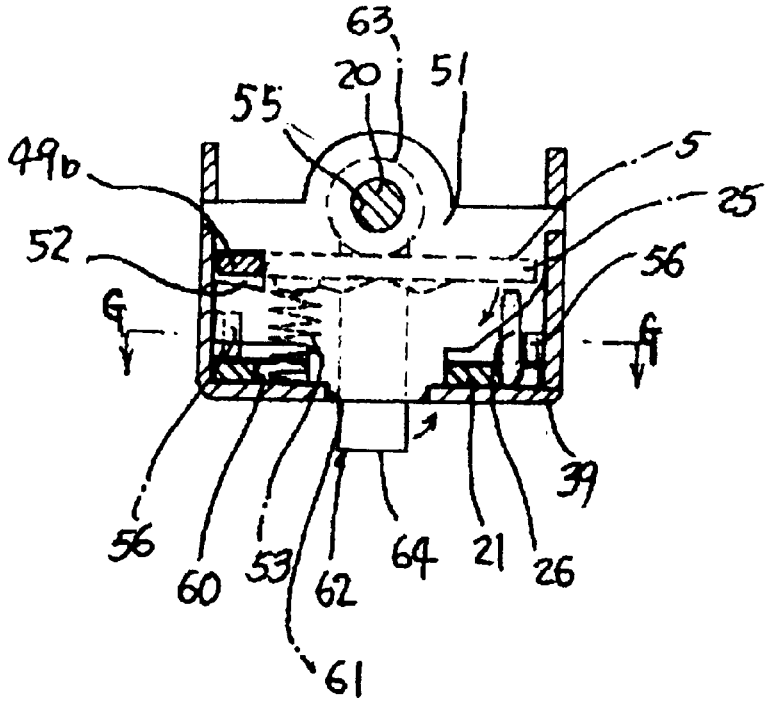
FIG. 8 is a cross-sectional view of combination lock, taken along the line A—A of FIG. 7.
Figure 9:
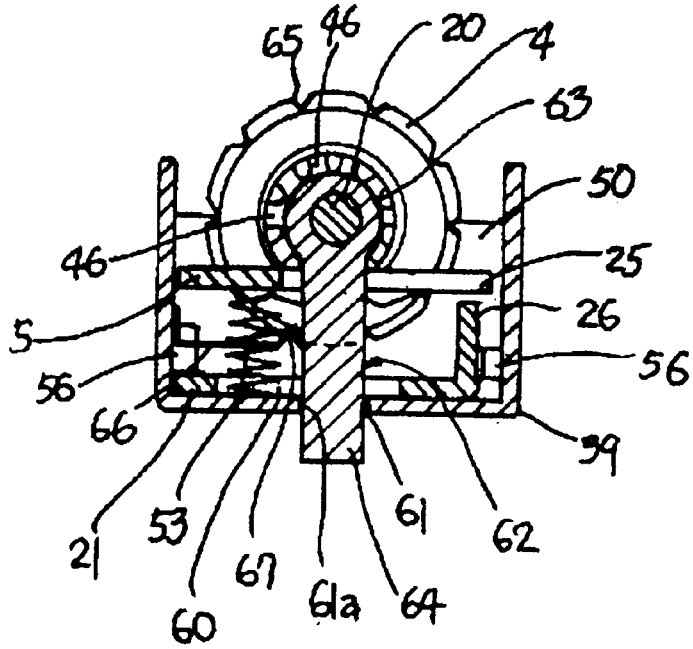
FIG. 9 is a cross-sectional view of combination lock, taken along the line B—B of FIG. 7.
Figure 10:
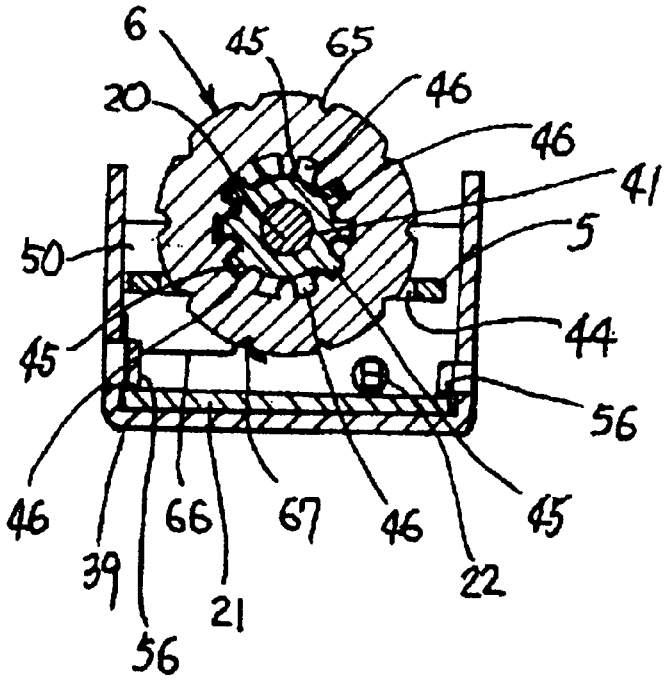
FIG. 10 is a cross-sectional view of combination lock, taken along the line C—C of FIG. 7.

Once such a predetermined unique combination of the marks is established, as shown in FIG. 4, the combination lock 6 is unlocked and therefore capable of moving to its unlocking position. In such an unlocked condition of the combination lock 6, as shown in FIGS. 8 and 9, the locking end portion 25 of the lock plate 5 is in a predetermined advanced position in which: the locking end portion 25 of the lock plate 5 is released from the restriction portion 26 of the slider 21: and, the slider 21 is capable of moving upward as viewed in FIG. 4. At this time, the cylinder lock 13 is in its locked condition, so that the upper end portion 14 of the stopping plate 11 is engaged with the shoulder portion 15 of the receiver lever 16 under the influence of a resilient force exerted by the first spring member 19. As a result, the handle 2 is held in its folded position inside a front concave portion 27 of the base body 1.

Under such circumstances, when the door handle 2 is forcibly pulled forward out of the base body 1, the door handle 2 is turned on a second pivot 28. As a result, the upper end portion 14 of the stopping plate 11 pushes swingably up the cam slope 18 of the shoulder portion 15 of the receiver lever 16. Due to such pushing operation of the stopping plate 11, the receiver lever 16 is turned on the first pivot 17 to unlock the door handle 2. At the same time, the receiver lever 16 pushes up a lower end portion 23 of the slider 21 so that the slider 21 is retracted upward from its lower extended position.

At a stage in which the door handle 2 is swingably pulled out of the base body 1 to reach a predetermined angular position thereof, the receiver lever 16 is released from a pushing force exerted by the upper end portion 14 of the stopping plate 11. Due to this, the receiver lever 16 swingably returns to its initial rest position under the influence of a resilient force exerted by the first spring member 19. At this time, the slider 21 also returns downward to its initial lower position under the influence of a resilient force exerted by the second spring member 22.

When the door handle 2, which is in its raised position, is turned sideward on the locking shaft 29, the locking member 3 which is directly or indirectly connected with the door handle 2 is released from the receiving portion (not shown) of the stationary frame element or main body of the box. This permits the door 30 (shown in FIG. 4) to be released from the above-mentioned receiving portion of the main body of the box. Consequently, any eligible person or user is capable of opening the door 30 by simply pulling the door handle 2 forward relative to the base body 1.

When the predetermined unique combination of the marks of the dial discs 4 is not established by rotating each of the dial discs 4, the lock plate 5 rotates in the direction of the arrow as shown in FIG. 8 to lock the combination lock 6. Due to this, the lock plate 5 has ifs locking end portion 25 abut against the restriction portion of the slider 21 to prevent the receiver lever 16 from turning upward on the first pivot 17 toward its escape position.

In this locked condition of the combination lock 6, when the door handle 2 is forcibly pulled forward out of the base body 1, the door handle 2 is very slightly pulled forward relative to the base body 1 to have immediately the upper end portion 14 of the stopping plate 11 abut against the cam slope 18 of the receiving lever 16, so that such a forcible forward pulling operation of the door handle 2 is inhibited by the stopping plate 11.

For example, the control operator of the instruments housed in the box, who allocates to each of the users or persons the predetermined unique combination of marks of the dial discs 4, has a broader control power than does each of the users or persons. Consequently, the control operator is capable of pulling forward and turning sideward the door handle 2 to open the door 30 without using the combination of the marks of the dial discs 4. Furthermore, the control operator is authorized to have the eligible key 7 of the cylinder lock 13.

When an illegal person, who is not authorized to use the box closed with the door 30, illegally operates or turn each of the dial discs 4 of the combination lock 6 to lock the combination lock 6 by accident, it is possible for the control operator to reset the combination lock 6 thus accidentally locked by the illegal person.

In a preliminary stage of the above-mentioned setting operation of the combination lock 6, the control operator inserts the key 7 into the keyhole 9 of the rotor 8 in the cylinder lock 13 to unlock the internal lock mechanism 10 of the cylinder lock 13 by using a predetermined coded key ridge portion of the key 7. This makes it possible for the rotor 8 of the cylinder lock 13 to rotate on its longitudinal center axis. When the key 7 thus inserted into the keyhole 9 of the rotor 8 is turned in the unlocking direction of the cylinder lock 13, the stopping plate 11 having been projected from the side through-hole 12 of the door handle 2 is retracted from the outside of the door handle 2 to be entirely inside the side through-hole 12, so that the upper end portion 14 of the stopping plate 11 is disengaged from the shoulder portion 15 of the receiver lever 16.

As described above, in the locking condition of the combination lock 6, since the locking end portion 25 of the lock plate 5 is in a position in which the locking end portion 25 abuts against the restriction portion 26 of the slider 21, the slider 21 is prevented from moving upward by means of the lock plate 5. As a result, the receiver lever 16 is prevented from turning on the first pivot 17 in its unlocking direction.

On the other hand, when the cylinder lock 13 is unlocked using the key 7, the stopping plate 11 is entirely retracted from the outside of the door handle 2 Therefore, there is no fear that the stopping plate 11 hits the receiver lever 16. Due to this, it is possible to pull the door handle 2 forward out of the front concave portion 27 of the base body 1 without any interference between the door handle 2 and the receiver lever 16.

After the door 30 of the box (not shown) is opened, an appropriate reset means such as a reset lever 63 is operated from behind the thus opened door 30 so that the combination lock 6 is released from such an accidental locking condition.

In the embodiment shown in the drawings, a bearing hole 31 is formed in an upper portion of the base body 1 to extend in a direction perpendicular to the plane of the front surface of the door 30. Rotatably received in such a bearing hole 31 of the base body 1 in an insertion manner is a locking shaft 29 which is not axially slidable in the bearing hole 31. The locking shaft 29 is provided with a square-column portion **29*a* in its rear end portion. All the locking member 3, a swing-angle limiting plate 71 and a washer 72 are mounted on the rear end square-column portion 29*a* of the locking shaft 29 in an insertion manner. Then, a bolt 101 is threadably connected with a threaded hole of a rear end surface of the square-column portion 29*a* of the locking shaft 29, and then tightened in the threaded hole of the locking shaft 29, so that the locking member 3 and the swing-angle limiting plate 71 are fixed to the square-column portion 29*a* of the locking shaft 29 through the washer 72**.

Formed in an upper rear portion of the handle 2 is a concave portion 36. This concave portion 36 assumes a substantially fan-like shape in longitudinal section to swingably receive therein a front end portion of the locking shaft 29 More specifically, the handle 2 had its upper end portion corresponding to its concave portion 36 pivoted to the front end portion of the locking shaft 29 through a second pivot or cross pivot 28. This cross pivot 28 extends in parallel with a front surface of the door 30 in a direction perpendicular to the longitudinal axis of the handle 2. In operation, when the handle 2 is folded down so as to be embedded in the base body 1, it is possible for the front concave portion 27 of the base body 1 to receive therein a rear portion of an essential part of the handle 2. Formed in a lower end portion of the handle 2 is a flange 37 serving as a fingertip engaging edge portion 37, which bulges out downward in the longitudinal direction of the door handle 2. Even when the handle 2 is in its folded position, the fingertip engaging edge portion 37 of the handle 2 is still spaced apart forward from a front surface of the corresponding lower portion of the base body 1, which enables the person or user to pick up the lower free end portion of the handle 2 in an easy manner.

On the other hand, when the door handle 2 is in its raised position in which the door handle 2 is inclined forward, it is possible for the user or person to swing sideward or turn the door handle 2 on the locking shaft 29 together with this locking shaft 29 relative to the base body 1.

Formed in an intermediate portion of the door handle 2 to extend in the longitudinal direction of the door handle 2 is an elongated hollow portion 38 for receiving therein a combination lock 6. The hollow portion 38 of the door handle 2 is open at the rear side of the door handle 2 to form an opening which is covered by a back plate member 39.

As is clear from FIGS. 7 to 19, the combination lock 6 is constructed of a plurality of its components. Essential ones of these components of the combination lock 6 are: a plurality of the marked dial discs 4, a plurality of cam discs 41, each of which has a part thereof inserted into a center through-hole of the dial disc 4 and stacked together into a neat pile; the center pin 20, which assumes the same shape as that of a round bar and inserted into a center hole 42 of each of the cam discs 41; a compression coil spring 43 for urging downward such a neat pile consisting of both the dial discs 4 and the cam discs 41 toward the cylinder lock 13; and, the lock plate 5, which is provided with a rectangular opening portion 44 to receive therein a part of each of the dial discs 4.

Figure 11:
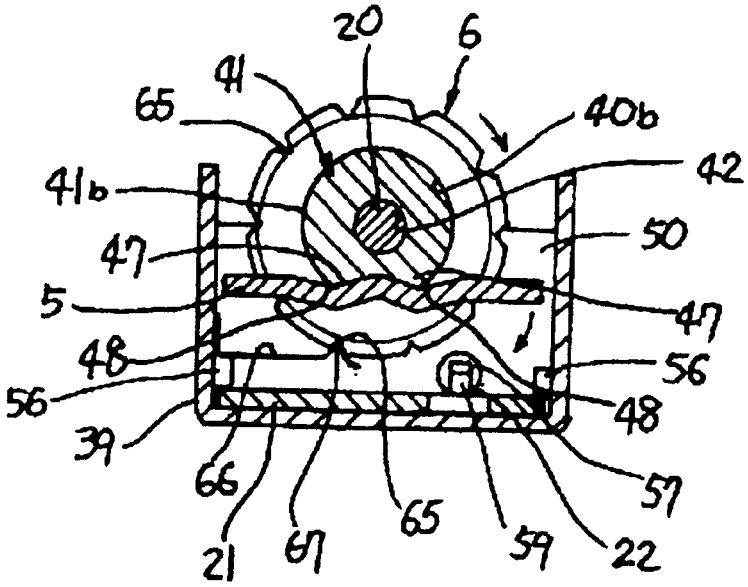
FIG. 11 is a cross-sectional view of combination lock, taken along the line D—D of FIG. 7.
Figure 12:
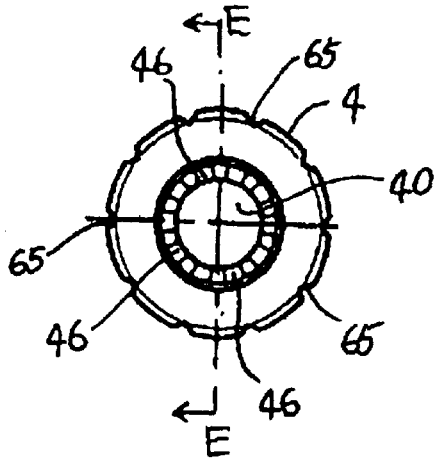
FIG. 12 is a plan view of the dial disc employed in the combination lock shown in FIG. 7.
Figure 13:
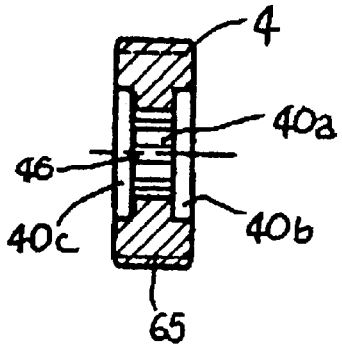
FIG. 13 is a longitudinal sectional view of the dial disc, taken along the line E—E of FIG. 12.

As shown in FIGS. 11 to 13, the center through-hole 40 of the dial disc 4 is constructed of: a small-diameter bore portion 40*a*; and, a pair of large-diameter bore portions 40*b* and 40*c*, sandwiched in between which is the small-diameter bore portion 40*a*. In a normal condition, under the influence of a resilient force exerted by the compression coil spring 43, a small-diameter sleeve portion 41*a* of the cam disc 41, which is inserted into the small-diameter bore portion 40*a* of the dial disc 4 from above, projects downward from the lower large-diameter bore portion 40*c* of the dial disc 4, so that a large-diameter flange portion 41*b* of the cam disc 41 is received in the upper large-diameter bore portion 40*b* of the dial disc 4. At the same time, the large-diameter flange portion 41*b* has its upper end surface abut against a lower end surface of the small-diameter sleeve portion 41*a* of the upper adjacent cam disc 41. A part of the peripheral portion of the dial disc 4 projects forward through a laterally elongated slot 68 formed in a front surface of the door handle 2.

Figure 14:
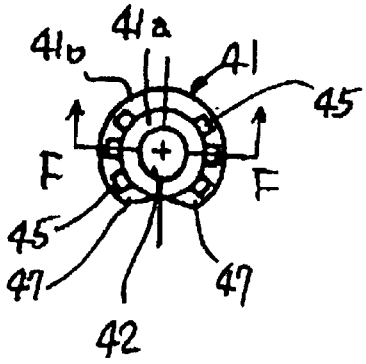
FIG. 14 is a bottom view of the cam disc employed in the combination lock shown in FIG. 7.
Figure 15:
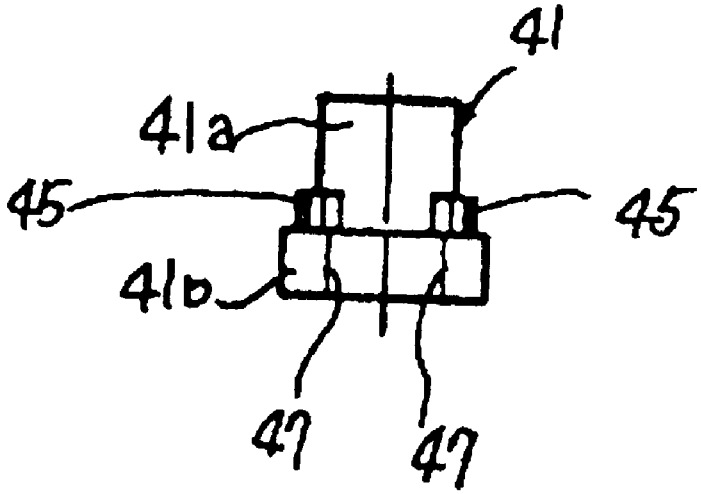
FIG. 15 is a rear view of the cam disc shown in FIG. 14.
Figure 16:
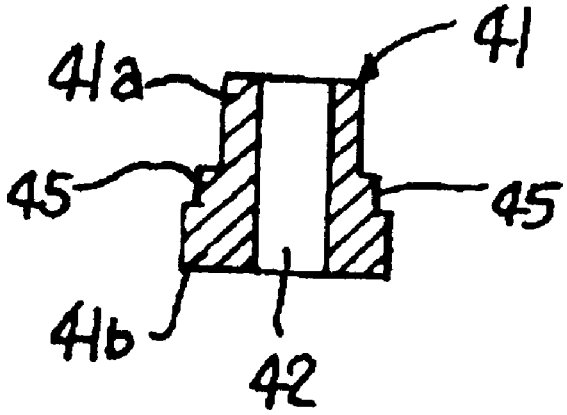
FIG. 16 is a longitudinal sectional view of the cam disc, taken along the line F—F
Figure 17:
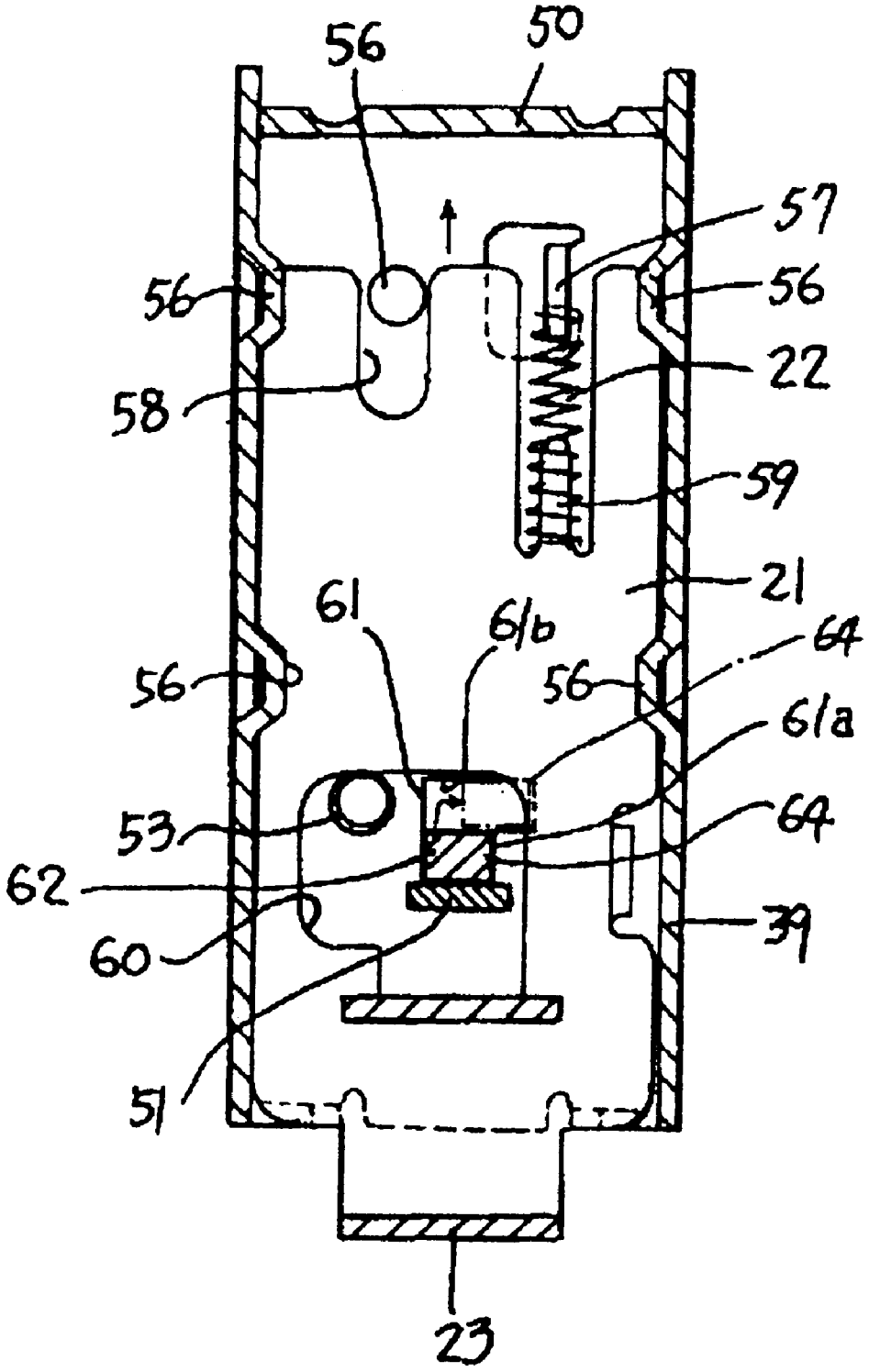
FIG. 17 is a longitudinal section view of the combination lock, taken along the line G—G of FIG. 8.
Figure 18:
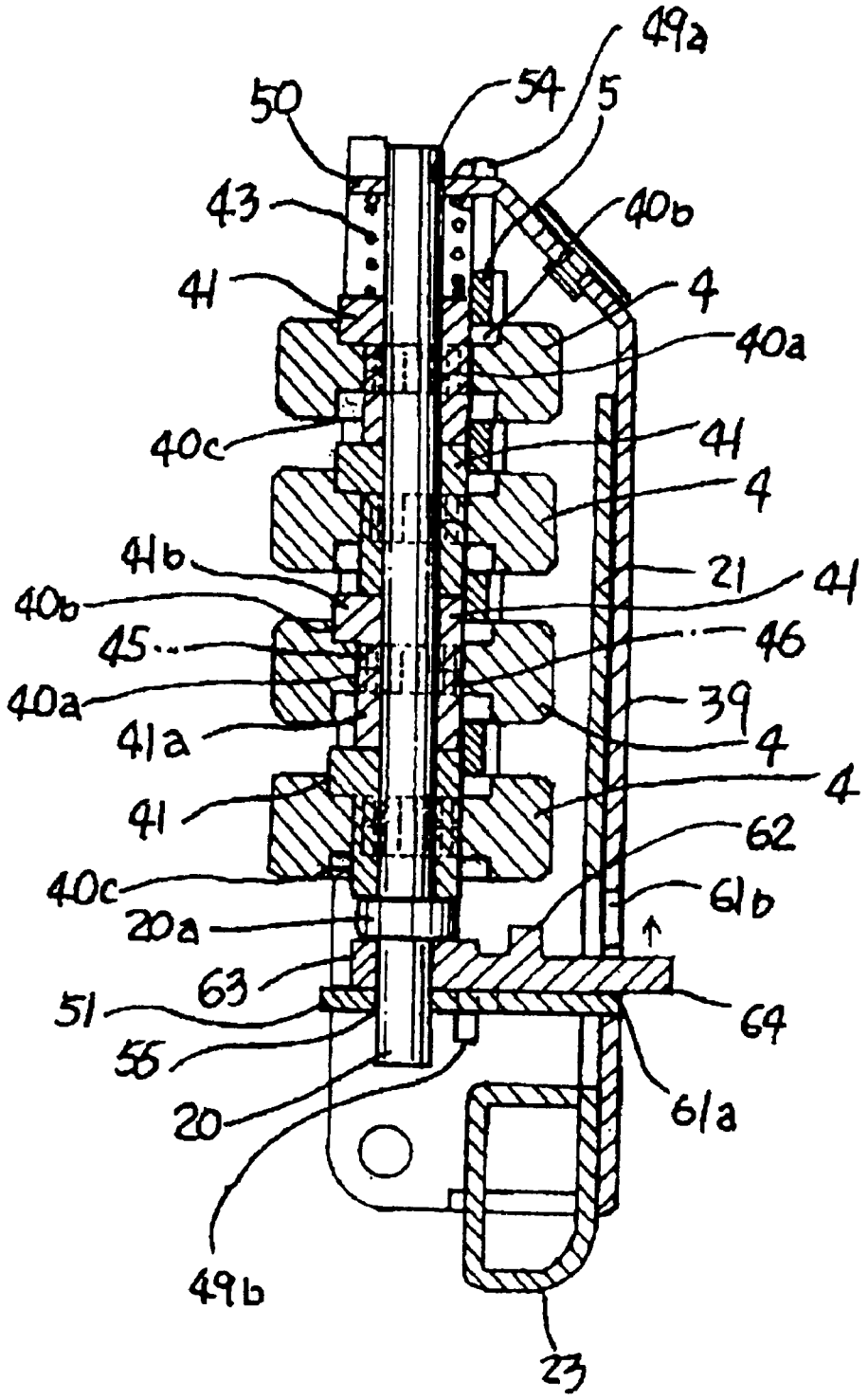
FIG. 18 is a longitudinal sectional view of the combination lock, taken along the line H—H of FIG. 7.
Figure 19:
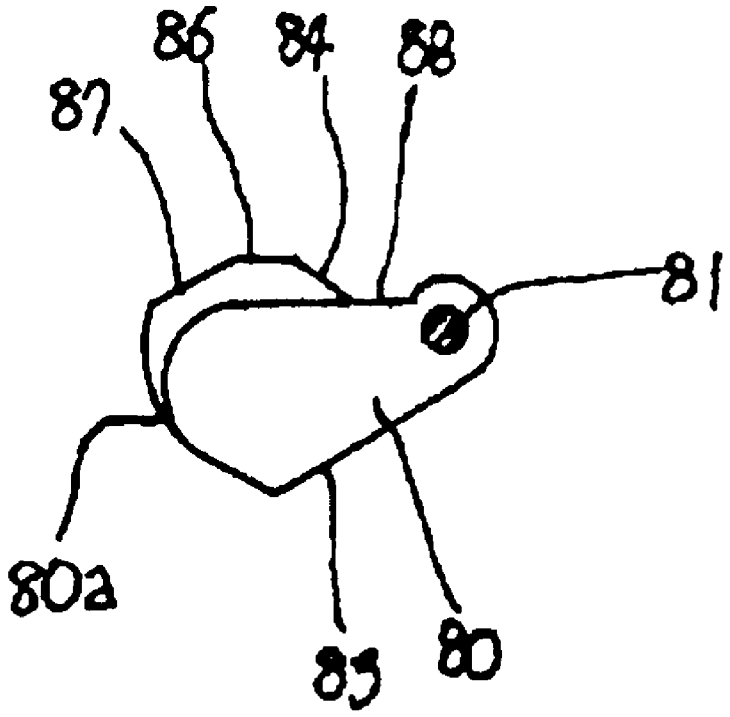
FIG. 19 a right side view of a fastening stopper employed in the combination lock shown in FIG. 1.

As shown in FIGS. 14 to 16, formed in a peripheral surface of a root portion of the small-diameter sleeve portion 41*a* of the cam disc 41 are a pair of diametrically opposed projection groups, each of which groups contains three piece of equally-spaced interlocking projections 45. On the other hand, formed in an inner peripheral surface of the small-diameter bore portion 40*a* of the dial disc 4 are ten piece of equally-spaced interlocking grooves 46 which corresponds in number to the marks "1" to "10" provided in the outer peripheral surface of the dial disc 4. The dial disc 4 and the corresponding cam disc 41 are combined with each other through engagement established between the interlocking projections 45 of the cam disc 41 and the corresponding interlocking grooves 46 of the dial disc 4.

In order to change the combination of the marks of the dial discs 4 in the combination lock 6, it is necessary to slide or displace the cam disc 41 upward by a distance equal to an axial length of the interlocking groove 46. Such an axial displacement of the cam disc 41 relative to the adjacent one of the dial discs 4 makes it possible for the cam disc 41 to have its interlocking projections 45 disengaged from the corresponding interlocking grooves 46 of the dial disc 4. After that, the cam disc 41 is rotated on its center axis relative to the dial disc 4 by a predetermined angle which is equal to an integral multiple of the interval between adjacent ones of the interlocking grooves 46. Then, the thus rotated cam disc 41 is returned or displaced downward to its initial level or height. As a result, the combination of marks of the dial disc 4 is changed to a new unique combination of the marks in the combination lock 6.

An outer peripheral portion of the large-diameter flange portion 41*b* of the cam disc 41 is partially cut off to form a pair of V-shaped notch portions 47 which are adjacent to each other to form a large-angle notch in appearance. The lock plate 5 is provided with a pair of V-shaped receiving grooves 48 in cross section. These grooves 48 of the lock plate 5 are formed in a bridge portion between adjacent ones of the rectangular opening portions 44 of the lock plate 5 and correspond, in position and contour, to the V-shaped notch portions 47 of the cam disc 41. When the V-shaped notch portions 47 of the cam disc 41 engage with the rectangular opening portions 44 of the lock plate 5, the lock plate 5 is in a position in which the locking end portion 25 of the lock plate 5 is free from the restriction portion 26 of the slider 21, when the V-shaped notch portions 47 of the cam disc 41 are disengaged from the rectangular opening portions 44 of the lock plate 5, a crest portion of the lock plate 48 in cross section between its V-shaped receiving grooves 48 abuts against the circular outer peripheral surface of the large-diameter flange portion 41*b* of the cam disc 41. This permits the lock plate 5 to rotate on its center axis to one of its angular positions, in which one the locking end portion 25 of the lock plate 5 abuts against is the restriction portion 26 of the slider 21.

An upper support protection 49*a* and a lower support projection 49*b* are formed in an upper end portion and a lower end portion of the lock plate 5 respectively. Further, the lock plate 5 has its support projections 49*a*, 49*b* oppositely disposed from its locking end portion 25. The upper support projection 49*a* is supported by an upright wall plate portion 50 of the back plate member 39. On the other hand, the lower support projection 49*b* is supported in a through-hole 52 of a partition wall plate 51 which is fixedly mounted on the back plate member 39. The lock plate 5 is resiliently urged forward by means of a compression coil spring 53 to prevent its locking end portion 25 from abutting against the restriction portion 26 of the slider 21.

The center pin 20 of the combination lock 6 has its upper and its lower end portion inserted into an upper pin hole 54 and a lower pin hole 55, respectively, wherein: the upper pin hole 54 is formed in the upright wall plate portion 50 of the back plate member 39; and, the lower pin hole 55 is formed in the partition wall plate 51. On the other hand, the compression coil spring 43 for urging downward both the dial discs 4 and the cam discs 41 is loosely mounted on the upper end portion of the center pin 20 and compressed between the uppermost one of the cam discs 41 and the upright wall plate portion 50.

The slider 21 is constructed of a plate member and capable of sliding along the back plate 39. A plurality of inner guide projections 56 are formed in both a main body and a pair of opposite side portions of the back plate 39 to extend inside the back plate 39 to slidably guide the slider 21. Also formed in the back plate 39 is a first spring support projection 57, which cooperates with a second spring support projection 59 of the slider 21 to support the compression coil spring or second spring member 22 therebetween. The second spring member 22 is used to urge the slider 21 downward toward the receiver lever 16. Further, the slider 21 is provided with a guide groove 58 which receives therein the guide projection 56 of the back plate 39.

The first pivot 17 of the receiver lever 16 extends in parallel with the front surface of the door 30. On the other hand, the slider 21 is provided with an escape opening 60 for preventing both the compression coil spring 53 and the partition wall plate 51 from interfering with the slider 21 in operation. An L-shaped opening 61 is formed in the back plate 39 oppositely disposed from the slider 21.

The center pin 20 of the combination lock 6 is provided with a flange portion 20*a* which abuts against the lowermost one of the cam discs 41 The reset lever 62 has its proximal end ring portion 63 rotatably mounted on the center pin 20 in a position between the flange portion 20*a* and the partition wall plate 51. On the other hand, in a normal condition, a grip portion 64 of the reset lever 62 passes through a vertical portion 61*a* of the L-shaped opening 61 of the back plate 39.

In order to perform the resetting operation or the changing operation of the combination of the marks of the dial discs 4 in the combination lock 6, it is necessary for the user to grip and push upward the grip portion 64 of the reset lever 62. The grip portion 64 of the reset lever 62 projects rearward beyond the back plate 39 through its L-shaped opening 61 to facilitate such a pushing-up operation of the reset lever 62. When the reset lever 62 thus pushed up, the pile of the cam discs 41 is pushed up toward the locking shaft 29 in a manner such that the interlocking projections 45 of the cam discs 41 are disengaged from the corresponding interlocking grooves 46 of the dial discs 4. In order to keep the pile of the cam discs 41 in their pushed-up position, it is necessary for the user to slightly tilt the reset lever 62 in a manner such that the grip portion 64 of the reset lever 62 is engaged with a lateral portion 61*b* of the L-shaped opening 61.

After turning each of the dial discs 4 in a normal or a reverse direction a desired number of times, the cam discs 41 have their interlocking projections 45 engaged with the corresponding interlocking grooves 46 of the dial discs 4 to determine a new combination of the marks of the dial discs 4, wherein such a new combination differs from the previous combination of the marks of the dial discs 4.

In the outer peripheral surface of each of the cam discs 41, there are formed a plurality of positioning grooves 66 at predetermined intervals. The number of these positioning grooves 65 of the cam disc 41 is the same as that of the marks of the dial disc 4. On the other hand, a third spring member 66 for keeping the dial discs 4 in their desired angular positions is fixedly mounted on the side wall portion of the back plate member 39 in a manner such that the third spring member 66 has its front end projections 67 resiliently engaged with the corresponding positioning grooves 65 of the cam discs 41.

As the internal lock mechanism 10 of the cylinder lock 13, there is used a conventional disc tumbler lock mechanism in which: an eccentric cam projection 69 formed in a rear end surface of the rotor 8 of the cylinder lock 13 is slidably received in a laterally elongated slot 70 formed in the proximal end portion of the stopping plate 11.

As an example of the internal lock mechanism 10, there is a pin tumbler lock mechanism or the like which is capable of being employed in the door locking handle assembly of the present invention.

The threaded hole 89 is formed on the base body 1 at a more inner position than the pivot 81 upright to the door 30. The set screw 82 may be fitted into the threaded hole 89 at a given length at the stage of forwarding or shipping.

The fastening stopper 80 of plate shape is provided with a stabilizing surface portion 86 on the more leading end side than the second cam surface portion 84. When the set screw 82 is fitted into the threaded hole 89 up to the required depth, the leading end portion abuts on the stabilizing surface portion 86.

Thereby, the fastening stopper 80 is stably held in such a full attaching position that the front side edge surface 80*a* of the fastening stopper 80 engages with simultaneously both the rear surface 93*c* of the front flange 93 and the rear side edge portion 32*b* of the attaching opening 32.

The fastening stopper 80 is provided with a locating surface portion 87 at the position between the stabilizing surface portion 86 and the front side edge surface 80*a*. When the locating surface portion 87 abuts on an inner side surface 94*a*, the fastening stopper 80 is retreated into the hollow portion 94 as a whole.

The spring 85 for the fastening stopper 80 is composed of a torsion coil spring. A bent portion 85*a* of the spring 85 is housed in a rear pocket portion of the hollow portion 94, and an elongated portion 85*b* of the spring 85 abuts on the inner side surface 94*a* of the hollow portion 94, and the other elongated portion 85*c* of the spring 85 abuts on a shoulder portion 88 of the fastening stopper 80.

A front surface 90*a* of the rear projection 90 of the base body 1 is inclined relative to the front surface 30*a* of the door 30 so as to make the operation of engagement between the locating groove 92 and the rear edge portion 32*a* of the attaching opening 32 much easier, so as to make the adjustment extent in relation to the change in door thickness much wider. The hollow portion also opens toward the other end of the base body 1. The front flange 93 is formed around the outer surface of the front end portion of the base body 1.

The base body 1 is provided with a heat radiation, hole(s) 99 on the wall. A holder member 95 is fixed to the inside surface of the base body 1 by screw 95*a*. receiver lever 16 is pivoted on the holder member 95 by a pivot 17. A spring 19 for the receiver lever 16 is composed of a torsion coil spring. A coil portion of the spring 19 is fitted on the pivot 17.

In the door locking handle assembly of the present invention of the first aspect: when the predetermined combination of the marks of the dial discs 4 of the combination lock 6 is established, the combination lock 6 is unlocked; the cylinder lock 13 is unlocked using the key 7; the combination lock 6 is incorporated in the handle 2 together with the cylinder lock 13 in a manner such that these locks 6, 13 are disposed adjacent to each other in the longitudinal direction of the handle 2; the receiver lever 16 pivoted to the base body 1 is controlled in motion by means of the lock plate 5; the stopper plate 11 which is engaged with and disengaged from the receiver lever 16 is mechanically interlocked with the rotor 8 of the cylinder lock 13 to make it possible to lock and unlock the handle 2 to and from the base body 1, so that it is possible for the present invention to downsize the door locking handle assembly in thickness as a whole in a condition in which a large number of eligible keys 7 are provided in an easy manner; and, it is possible for the control operator of the various instruments contained in the box or container to control a large number of the users or persons in various control modes through the computerized personal management system without fail.

Further, in the door locking handle assembly of the first aspect, it is possible to prevent the receiver lever 16 from turning or moving toward its unlocked position by simply having the upper end portion 14 of the stopping plate 11 abut against the cam slope 18 of the receiver lever 16. Due to this, in the door locking handle assembly of the present invention, there is no need for a separate drive mechanism for driving the receiver lever 16. This makes it possible to reduce the number of the components or parts of the door locking handle assembly and therefore possible to simplify the assembly in construction.

If other physical solid body collides or contacts with the front surface 2*a* of the handle 2 under transportation or in use, the marked dial discs 4 do not collide or contact with it directly, because an outer peripheral portion of each of the dial discs 4 projects into the dent portion 100 through the slot 68 of the handle 2 in such a manner that the outer peripheral surface of the dial disc 4 is set back from a virtual extension plane of the front surface 2*a* of the handle 2. Thereby, the marked dial discs 4 are prevented from getting out of order or breaking down, and their function can be kept in good stability.

In the door locking handle assembly of the invention of the first aspect and the third aspect, the base body 1 is fitted into an attaching opening 32 of a door 30 so that the rear edge portion 32*a* of one of longitudinal ends of the attaching opening 32 is engaged with a locating groove (92), which is formed between the rear projection (90) and one of longitudinal ends (93*a*) of the front flange (93), and then, the set screw 82 is driven into the threaded hole 89 of the base body 1 so that the leading end of the set screw 82 pushes the fastening stopper 80, and thereby, the fastening stopper 80 is rotated outward so that the front side edge surface 80*a* of the fastening stopper 80 engages with both the rear surface 93*c* of said end portion 93*b* of the front flange 93 and the rear side edge portion 32*b* of the other of longitudinal ends of the attaching opening 32. As a result, the base body 1 is fixedly fastened to the door 30 with having the front flange 93 abutted on the front surface 30*a* thereof.

Therefore, it is not necessary to perforate threaded holes and through holes for attaching screws in the door, and it is easy to simplify the perforating works.

In the door locking handle assembly of the invention of the fourth aspect, when the base body 1 is inserted into the attaching opening 32, and the front flange 93 of the base body 1 abuts onto the front surface 30*a* of the door 30, the fastening stopper 80 is rotated automatically by the spring 85 so that the front side edge surface 80*a* of the fastening stopper 80 engages with both the rear surface 93*c* of the front flange 93 and the rear side he portion (32*b*) of the attaching opening (32). Because the base body 1 is temporarily held in a given attaching position in such a way, there is no need to hold the door handle assembly from the front side of the door in he screw fixing operation. As a result, the operation efficiency in attaching is more improved.

In the door locking handle assembly of the invention of the fifth aspect, the handle assembly can be adapted various doors, which are different in thickness, because the front side edge surface 80*e* of the fastening stopper 80 is formed as curved shape.

In the door looking handle assembly of the invention of the sixth aspect, the base body 1 is fixed on the door 30 with cooperation of the locating groove 92 and the fastening stopper 80, and thereafter, the leading end of a pushing screw 97, which is fitted into said threaded hole 98, abuts or pushes to the rear surface 30*b* of the door 30. Therefore, the attaching of the handle assembly to the door 30 is accomplished much securely.

What is claimed is:

1. In a door locking handle assembly with a built-in combination lock (6), the assembly being provided with a base body (1) which is fixedly mounted on a door (30) of a box, wherein a handle (2) is pivoted to said base body (1) so as to be capable of being pulled out forward and pushed back rearward relative to said base body (1), wherein a locking member (3) serving as a door bolt for locking said door (30) to a main body of said box is directly or indirectly connected with said handle (2) so as to be engaged with and disengaged from a receiving portion of a stationary frame element such as said main body of said box when said handle (2) is pulled out forward and then turned sideward on said locking shaft (29) after completion of the pulling-out operation of said handle (2), the improvement wherein:

said combination lock (6), which is provided with a plurality of marked dial discs (4), is incorporated in said door handle (2) and opened by turning each of said marked dial discs (4) a given number of times to establish a predetermined combination of marks for unlocking, which marks are provided on outer peripheral surfaces of said dial discs (4);

said combination lock (6) is held in its locked condition when said predetermined combination of marks for locking is not established;

a plurality of slots (68) are formed on a bottom surface of a dent portion (100), which is formed on a front surface of said handle (2);

an outer peripheral portion of each of said dial discs (4) projects into said dent portion (100) through said slot (68) in such a manner that an outer peripheral surface of said dial disc (4) is set back from a virtual extension plane of the front surface (2*a*) of said handle (2);

a cylinder lock (13) is incorporated in said handle (2) and disposed adjacent to said combination lock (6) in a longitudinal direction of said handle (2), wherein said cylinder lock (13) is provided with a rotor (8);

when a key (7) is inserted into a keyhole (9) of said rotor (8) of said cylinder lock (13), said cylinder lock (13) has its internal lock mechanism (10) unlocked to permit said rotor (8) to be turned by said key (7) thus inserted into said keyhole (9) of said rotor (8);

when said roto (8) is turned a stopper plate (11) which is slidably received in a side through-hole (12) of said handle (2) is driven in a manner such that said stopping plate (11) is projected outward from said side through-hole (12) and retracted from the outside of said door handle (2);

said stopping plate (11) has its upper end portion (14) abut against a shoulder portion (15) of a lower surface of a proximal end portion of a receiver lever (16);

said receiver lever (16) has its proximal end portion pivoted to an inner wall portion of said base body (1) through a first pivot (17);

said shoulder portion (15) of said receiver lever (16) is provided with a cam slope (18) through which said receiver lever (16) is pushed upward by said upper end portion of said stopper plate (11);

said receiver lever (16) is rotatably urged toward said stopping plate (11) by means of a first spring member (19);

a slider (21) is disposed in parallel with a center pin (20) of said combination lock (6), and urged toward said cylinder lock (13) by means of a second spring member (22) in a manner such that a lower end portion (23) of said slider (21) abuts against an upper surface of said receiver lever (16), so that said slider (21) has its restriction portion (26) engaged with and disengaged from a locking end portion (25) of a lock plate (5) when said lock plate (5) is held in its locked position and its unlocked position, respectively;

when said lock plate (5) is held in its unlocked position, said handle (2) is capable of being pulled forward out of said base body (1);

when said handle (2) is thus pulled out forward, said stopping plate (11) pushes said cam slope (18) of said receiver lever (16) swingably upward so that said receiver lever (16) is moved to its unlocked position; and when said lock plate (5) is held in its locked position, said lock plate (5) has its locking end portion (25) engaged with said restriction portion (26) of said slider (21) to prevent said receiver lever (16) from turning on said first pivot (17).

2. The door locking handle assembly having the structure of a claim 1, which assembly has further the following structure, wherein;

said base body (1) is fitted into an attaching opening (32) of a door (30) from the front side of the door (30), and a front flange (93) is formed on outer surface of the base body (1), which front flange abuts on a front surface (30*a*) of the door (30);

a rear projection (90), which is formed on one of longitudinal ends of the base body (1), passes through the attaching opening (32) to the rear side of the door (30);

a rear edge portion (32*a*) of one of longitudinal ends of the attaching opening (32) engages with a locating groove (92), which is formed between said rear projection (90) and one of longitudinal ends (93*a*) of said front flange (93);

a hollow portion (94), which is formed in the other of longitudinal ends of said base body (1) disposed on the rear side of the door (30), is opened toward the other end (93*b*) of longitudinal ends of said front flange (93);

a fastening stopper (80) is housed in said hollow portion (94), and pivoted to said base body (1) by a pivot (81) which is parallel to the front surface (30*a*) of said door (30);

a set screw (82) is fitted through a threaded hole (89), which is formed in a rear wall portion the base body (1), and a leading end of the set screw (82) projects into the hollow portion (94); and a front side edge surface (80*a*) of said fastening stopper (80) is brought into engagement with both a rear surface (93*c*) of said end portion (93*b*) of the front flange (93) and a rear side edge portion (32*b*) of the other of longitudinal ends of said attaching opening (32) with pressing the fastening stopper (80) by said set screw (82).

3. The door locking handle assembly having the structure of claim 2, which assembly has further the following structure, wherein;

when the base body (1) is inserted into the attaching opening (32) of the door (30), a first cam surface portion (83), which is formed on the outer edge of said fastening stopper (80), slidably contacts with the front side edge portion (32*c*) of the other of longitudinal ends of the attaching opening (32) so that the fastening stopper (80) is retreated into said hollow portion 94; and when the set screw (82) is fitted through the threaded hole (89), a second cam surface portion (84), which is formed on the inner edge of the fastening stopper (80), slidably contacts with a leading end of said set screw (82) so that the fastening stopper (80) is pushed out ward from the hollow portion (94).

4. The door locking handle assembly having the structure of claim 2, which assembly has further the following structure, wherein;

a spring member (85), which is disposed between the fastening stopper (80) and the base body (1), urges the fastening stopper (80) so as to project outside of the rear edge portion (32*b*) of the attaching opening (32).

5. The door locking handle assembly having the structure of claim 2, which assembly has further the following structure, wherein;

said front side edge surface (80*a*) of said fastening stopper (80), which is formed as a curved shape, engages with both the rear surface (93*c*) of said end portion (93*b*) of the front flange (93) and the rear side edge portion (32*b*) of the other of longitudinal ends of said attaching opening (32).

6. The door locking handle assembly having the structure of claim 2, which assembly has further the following structure, wherein;

a threaded hole (98) is formed on said rear projection (90) of the base body (1) upright to the door (30), and a leading end of a pushing screw (97), which is fitted into said threaded hole (98), abuts onto a rear surface (30*b*) of the door (30).

7. In a door locking handle assembly with a built-in combination lock (6), the assembly being provided with a base body (1) which is fixedly mounted on a door (30) of a box, wherein a handle (2) is pivoted to said base body (1) so as to be capable of being pulled out forward and pushed back rearward relative to said base body (1), wherein a locking member (3) serving as a door bolt for locking said door (30) to a main body of said box is directly or indirectly connected with said handle (2) so as to be engaged with and disengaged from a receiving portion of a stationary frame element such as said main body of said box when said handle (2) is pulled out forward and then turned sideward on said locking shaft (29) after completion of the pulling-out operation of said handle (2), the improvement wherein:

said combination lock (6), which is provided with a plurality of marked dial discs (4), is incorporated in said door handle (2) and opened by turning each of said marked dial discs (4) a given number of times to establish a predetermined combination of marks for unlocking, which marks are provided on outer peripheral surfaces of said dial discs (4);

said combination lock (6) is held in its locked condition when said predetermined combination of marks for locking is not established;

a plurality of slots (68) are formed on a bottom surface of a dent portion (100), which is formed on a front surface of said handle (2);

an outer peripheral portion of each of said dial discs (4) projects into said dent portion (100) through said slot (68) in such a manner that an outer peripheral surface of said dial disc (4) is set back from a virtual extension plane of the front surface (2*a*) of said handle (2);

a cylinder lock (13) is incorporated in said handle (2) and disposed adjacent to said combination lock (6) in a longitudinal direction of said handle (2), wherein said cylinder lock (13) is provided with a rotor (8);

when a key (7) is inserted into a keyhole (9) of said rotor (8) of said cylinder lock (13), said cylinder lock (13) has its internal lock mechanism (10) unlocked to permit said rotor (8) to be turned by said key (7) thus inserted into said keyhole (9) of said rotor (8);

when said rotor (8) is turned, a stopper plate (11) which is slidably received in a side through-hole (12) of said handle (2) is driven in a manner such that said stopping plate (11) is projected outward from said side through-hole (12) and retracted from the outside of said door handle (2);

said stopping plate (11) has its upper end portion (14) abut against a shoulder portion (15) of a lower surface of a proximal end portion of a receiver lever (16);

said receiver lever (16) has its proximal end portion pivoted to an inner wall portion of said base body (1) through a first pivot (17);

said shoulder portion (15) of said receiver lever (16) is provided with a cam slope (18) through which said receiver lever (16) is pushed upward by said upper end portion of said stopper plate (11);

said receiver lever (16) is rotatably urged toward said stopping plate (11) by means of a first spring member (19);

a slider (21) is disposed in parallel with a center pin (20) of said combination lock (6), and urged toward said cylinder lock (13) by means of a second spring member (22) in a manner such that a lower end portion (23) of said slider (21) abuts against an upper surface of said receiver lever (16), so that said slider (21) has its restriction portion (26) engaged with and disengaged from a locking end portion (25) of a lock plate (5) when said lock plate (5) is held in its locked position and its unlocked position, respectively;

when said lock plate (5) is held in its unlocked position, said handle (2) is capable of being pulled forward out of said base body (1);

when said handle (2) is thus pulled out forward, said stopping plate (11) pushes said cam slope (18) of said receiver lever (16) swingably upward so that said receiver lever (16) is moved to its unlocked position;

when said lock plate (5) is held in its locked position, said lock plate (5) has its locking end portion (25) engaged with said restriction portion (26) of said slider (21) to prevent said receiver lever (16) from turning on said first pivot (17); wherein:

said base body (1) is fitted into an attaching opening (32) of a door (30) from the front side of the door (30), and a front flange (93) is formed on outer surface of the base body (1), which front flange abuts on a front surface (30*a*) of the door (30);

a rear projection (90), which is formed on one of the longitudinal ends of the base body (1), passes through the attaching opening (32) to the rear side of the door (30);

a rear edge portion (32*a*) of one of longitudinal ends of the attaching opening (32) engages with a locating groove (92), which is formed between said rear projection (90) and one of longitudinal ends (93*a*) of said front flange (93);

a hollow portion (94), which is formed in the other of longitudinal ends of said base body (1) disposed on the rear side of the door (30), is opened toward the other end (93*b*) of longitudinal ends of said front flange (93);

a fastening stopper (80) is housed in said hollow portion (94), and pivoted to said base body (1) by a pivot (81) which is parallel to the front surface (30*a*) of said door (30);

a set screw (82) is fitted through a threaded hole (89), which is formed in a rear wall portion of the base body (1), and a leading end of the set screw (82) projects into the hollow portion (94);

a front side edge surface (80*a*) of said fastening stopper (80) is brought into engagement with both a rear surface (93*c*) of said end portion (93*b*) of the front flange (93) and a rear side edge portion (32*b*) of the other of longitudinal ends of said attaching opening (32) with pressing the fastening stopper (80) by said set screw (82), whereby:

when the base body (1) is inserted into the attaching opening (32) of the door (30), a first cam surface portion (83), which is formed on the outer edge of said fastening stopper (80), slidably contacts with the front side edge portion (32*c*) of the other of longitudinal ends of the attaching opening (32) so that the fastening stopper (80) is retreated into said hollow portion 94; and when the set screw (82) is fitted through the threaded hole (89), a second cam surface portion (84), which is formed on the inner edge of the fastening stopper (80), slidably contacts with a leading end of said set screw (82) so that the fastening stopper (80) is pushed outward from the hollow portion (94).

* * * * *